US006029596A

United States Patent [19]

Hoofman et al.

[11] Patent Number: 6,029,596

[45] Date of Patent: Feb. 29, 2000

[54] APPARATUS AND METHOD FOR SECURING WATERCRAFT

[76] Inventors: Michael Hoofman, 1712 Bobbitt La., North Little Rock, Ark. 72120; Donald Dawson, 121 Ramblewood, Blytheville, Ark. 72315

[21] Appl. No.: 09/193,998

[22] Filed: Nov. 18, 1998

[51] Int. Cl.[7] ..... B63B 21/00

[52] U.S. Cl. ..... 114/230.1; 114/230.15

[58] Field of Search ..... 114/230.1, 230.11, 114/230.15, 230.16, 230.17, 230.18, 230.19, 221 R

[56] References Cited

U.S. PATENT DOCUMENTS 2,387,352 10/1945 Radick ..... 114/230.15
2,456,839 12/1948 Princell ..... 114/230.15
2,679,818 6/1954 Herbert et al. ..... 114/230.15
2,930,339 3/1960 Trnka ..... 114/230.15
2,965,064 12/1960 Wallace ..... 114/216

*Primary Examiner*—Stephen Avila
*Attorney, Agent, or Firm*—Joe D. Calhoun

[57] ABSTRACT

An apparatus and method for securing a watercraft to a mooring structure, comprising inserting into a hole in a watercraft the lowermost end of a leg attached to a boom arm, situating said boom arm within a mooring position channel, and inserting the lowermost end of an opposite leg into a stabilizing means of a mounting base mounted to a mooring structure.

12 Claims, 4 Drawing Sheets

APPARATUS AND METHOD FOR SECURING WATERCRAFT

FIELD OF THE INVENTION

The present invention relates to an apparatus for mooring and/or securing a watercraft to a dock, houseboat or similar item. Although the invention may be used for watercraft of different sizes, the invention is particularly suitable for person watercraft and small boats.

BACKGROUND OF THE INVENTION

Although several problems relating to securing watercraft are well known, solutions remain unsatisfactory for a variety of reasons. The ideal mooring device will maintain the positioning of the watercraft relative to the mooring structure, in such a manner to prevent or minimize any damage to the watercraft due to horizontal or vertical movement resulting from the movement of waves or water level relative to the mooring structure. An ideal mooring apparatus will also be easy to use, without being an obstacle when not in use. There are a number of patented mooring devices, such as:

| U.S. Pat. No. | Inventor |
|---|---|
| 5,493,991 | Wright, et al. |
| 5,408,946 | Jones, et al. |
| 5,243,929 | Wright, et al. |
| 4,066,030 | Milone |
| 2,965,064 | Wallace |

However, most of those devices suffer from being too complicated or cumbersome to use, and too expensive to manufacture.

SUMMARY OF THE INVENTION

The present invention relates to an apparatus and method for conveniently mooring and, if desired, securing a watercraft adjacent to a mooring structure such as a dock or houseboat. The present invention may be used for any watercraft having a hole or similar mooring eyelet through an essentially horizontally aligned surface such as, for example (not limitation), the prow or a gunwale. For such watercraft, no other means is necessary for attaching the watercraft to the invention.

One primary object of the invention is to provide an apparatus that is easily used, and easily put in an essentially out-of-the-way position ready for use. Another object of the invention is to provide a mooring and securing apparatus that is economical to manufacture, and easy to install. Another object of the invention is to provide a mooring and securing apparatus that is readily usable with a variety of watercraft, without the necessity of having varied attachment means for each different watercraft. Another object of the invention is to provide a method of mooring and securing a watercraft that facilities all of the above objectives.

BRIEF DESCRIPTION OF DRAWINGS

The following describes the drawings accompanying this application, which are incorporated herein.

Figure 1:
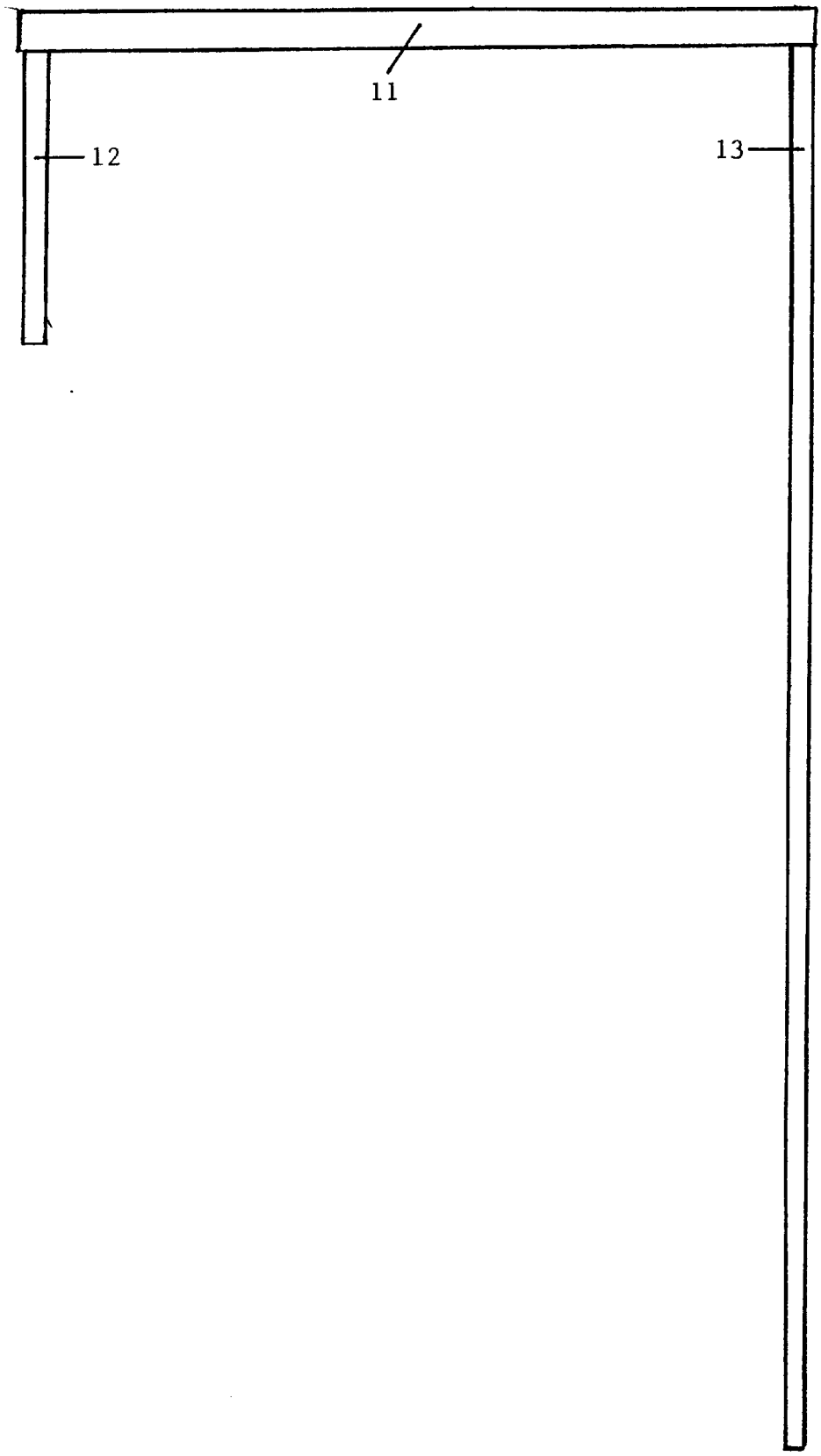
FIG. 1 depicts a side elevation view of one version of a mooring member, including a boom arm (11) having a shorter proximal leg (12) downstanding from its proximal end and a longer distal leg (13) downstanding from its distal end.

Although these drawings illustrate certain details of certain embodiments, the invention disclosed herein is not limited to only the embodiments so illustrated. The invention disclosed herein may have equally effective or legally equivalent embodiments.

DETAILED DESCRIPTION OF THE INVENTION

Before the present invention is described in detail, it is to be understood that the invention is not limited to the particular configurations, process steps and materials disclosed herein. It is also to be understood that the terminology used herein is not intended to be limiting, since the scope of the present invention will be limited only by the claims and equivalents thereof. Also, as used herein, the singular forms include the plurals, and vice versa, unless the context indicates otherwise.

In most general terms, the invention comprises an apparatus for mooring watercraft having at least one rigid mooring member, for interfacing with the watercraft, that can be engaged with a base mounted or otherwise secured to a mooring structure. (Although the description in this application definitely envisions a standard mounting of said base to either the sidewall or deck of a dock or houseboat, said base may be mounted on any other mooring structure by any other means.) In general, said mooring member is essentially a boom arm having a downstanding leg at both ends, the leg closest to the dock (the proximal leg) being for attaching the boom arm to the mounting base mounted on the dock, the leg further from the dock (the distal leg) being for inserting through a hole or similar mooring eyelet through an essentially horizontal surface of the watercraft, and extending beneath the surface of the water a sufficient distance to prevent the watercraft from escaping said mooring connection. (This invention is not necessarily limited by the order of either engaging the proximal leg of the boom arm with the mounting base, or impaling the mooring eyelet of the watercraft with the distal leg of the boom arm.)

One of the important aspects of the invention is that the watercraft maintains its impaled connection with the mooring apparatus by its own buoyancy; the buoyancy of the watercraft essentially prevents the watercraft from submerging far enough below the water surface to allow the watercraft to slip off the end of the distal leg protruding below the water surface. It is also important to some versions of the invention that the mooring member may be locked in either a mooring position outstretched over the water, or in a lateral position essentially parallel and adjacent to the mooring structure, by insertion of a locking device through essentially matched channels or holes drilled, punched or otherwise created through the upper portions of paired walls defining channels wherein the boom arm is situated. If the lock is inserted while the boom arm is in a lateral position channel, the lock will prevent the boom arm from being removed from the mounting base. If the lock is inserted while the boom arm is in a mooring position channel, the boom arm may not be readily removed to allow the removal of either the boom arm or the watercraft impaled by the distal leg of the boom arm.

The mooring member is comprised of at least one essentially horizontally oriented boom arm having at least one end proximal to the mooring structure and at least one end distal from the mooring structure. Said boom arm also has at least one essentially vertically oriented distal leg depending downwardly from said distal end a sufficient downward distance to prevent a watercraft impaled thereby from disimpaling. Said boom arm also has at least one essentially vertically oriented proximal leg depending downwardly from said proximal end a sufficient distance to facilitate engagement of said mooring member with a base attached to the mooring structure.

Said base includes a rigid plate essentially in the shape of an inverted L, said plate having an essentially vertically oriented portion for securing to the mooring structure. Said plate also includes an essentially horizontally oriented portion having an upper surface and a lower surface and having an end proximal to the mooring structure and an end distal therefrom. Said upper surface of said horizontal portion has at least one upstanding pair of essentially parallel walls defining at least one channel extending along said horizontal portion from at least near said proximal end to at least near said distal end. Said horizontal portion also defines at least one portal between said upper surface and said lower surface, said portal sized to closely accept insertion of a lowermost portion of said proximal leg of said mooring member when said boom arm is situated within said channel. Said base may further include a means for stabilizing said proximal leg of said mooring member to facilitate the stable engagement of said proximal leg (with accompanying boom arm and distal leg) with said base.

Although the description of the invention in this application definitely envisions an apparatus having only one boom arm per mounting base, the invention also includes an apparatus capable of including a plurality of boom arms carried either by a single proximal leg engaged with a single stabilizing means, or by a plurality of boom arms each of which is carried by a separate proximal leg engaged with a separate stabilizing means, and combinations thereof. In each respective embodiment of the invention, the channels on the upper surface of the horizontal portion of the base are aligned to accept the respective boom arm as needed for the respective configuration of boom arms.

Another version of the apparatus includes a plurality of channels in the invention described above. Additionally, said stabilizing means and said portal in said horizontal portion of said mounting base are cooperatively sized and adapted to facilitate pivoting of said proximal leg of said mooring member to accommodate the placement of said boom arm into said channels separately, enabling said engagement when said boom arm is situated within any one of said channels.

In another version of the apparatus described above, said proximal leg of said mooring member is cylindrical, and said stabilizing means is comprised of a rigid sleeve attached to said base and having its chamber opening situated directly beneath said portal. Said sleeve defines an essentially cylindrical interior chamber sized to closely accept the insertion of a lowermost portion of said cylindrical proximal leg of said mooring member, enabling the pivoting therein of said proximal leg along its longitudinal axis until said boom arm is situated within a channel.

Figure 2:
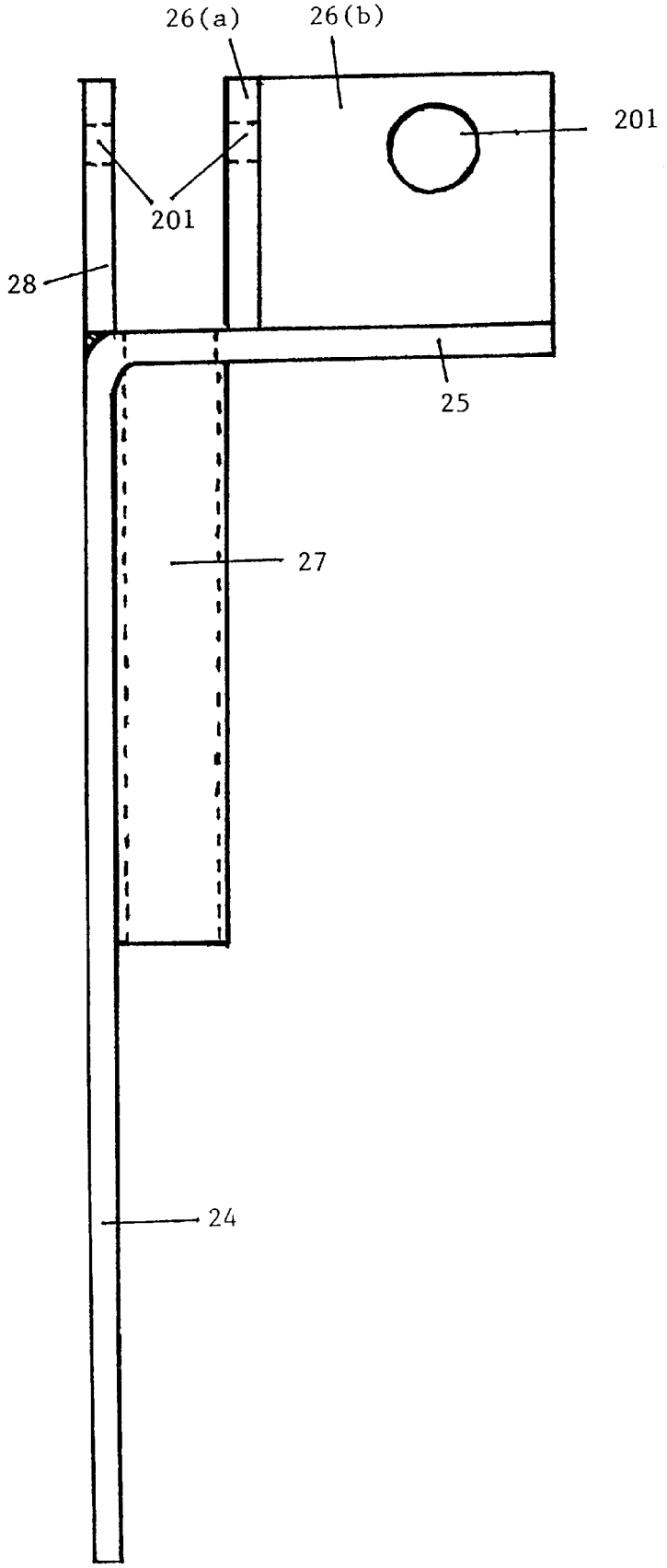
FIG. 2 depicts a side elevation view of one version of a mounting base, including a vertical portion (24), a horizontal portion (25), an L-wall (26), an eyelet hole (201) and a stabilizing means (27). 26(*b*) depicts a side view of one leg of an L-wall, whereas 26(*a*) depicts an end of the other leg of the L-wall, which extends away from the viewer before joining 26(*b*) essentially perpendicular thereto; 28 similarly depicts a view of the end of a juncture-aligned wall, extending away from the viewer. Each of the dashed lines within the stabilizing means (27) is intended to demarcate the interior wall of the stabilizing means, defining a cylindrical interior chamber. Each pair of dashed lines through 28 and 26(*a*) is intended to demarcate the boundaries of matching eyelet holes (201) through those walls, said holes sized to accept a locking device transversing a channel defined by said walls. The circle in 26(*b*) is intended to depict another eyelet hole through that side-viewed portion of an L-wall, it being understood that a matching hole is also situated in a matching portion of a mirroring L-wall situated behind that portion of L-wall depicted as 26(*b*).
Figure 3:
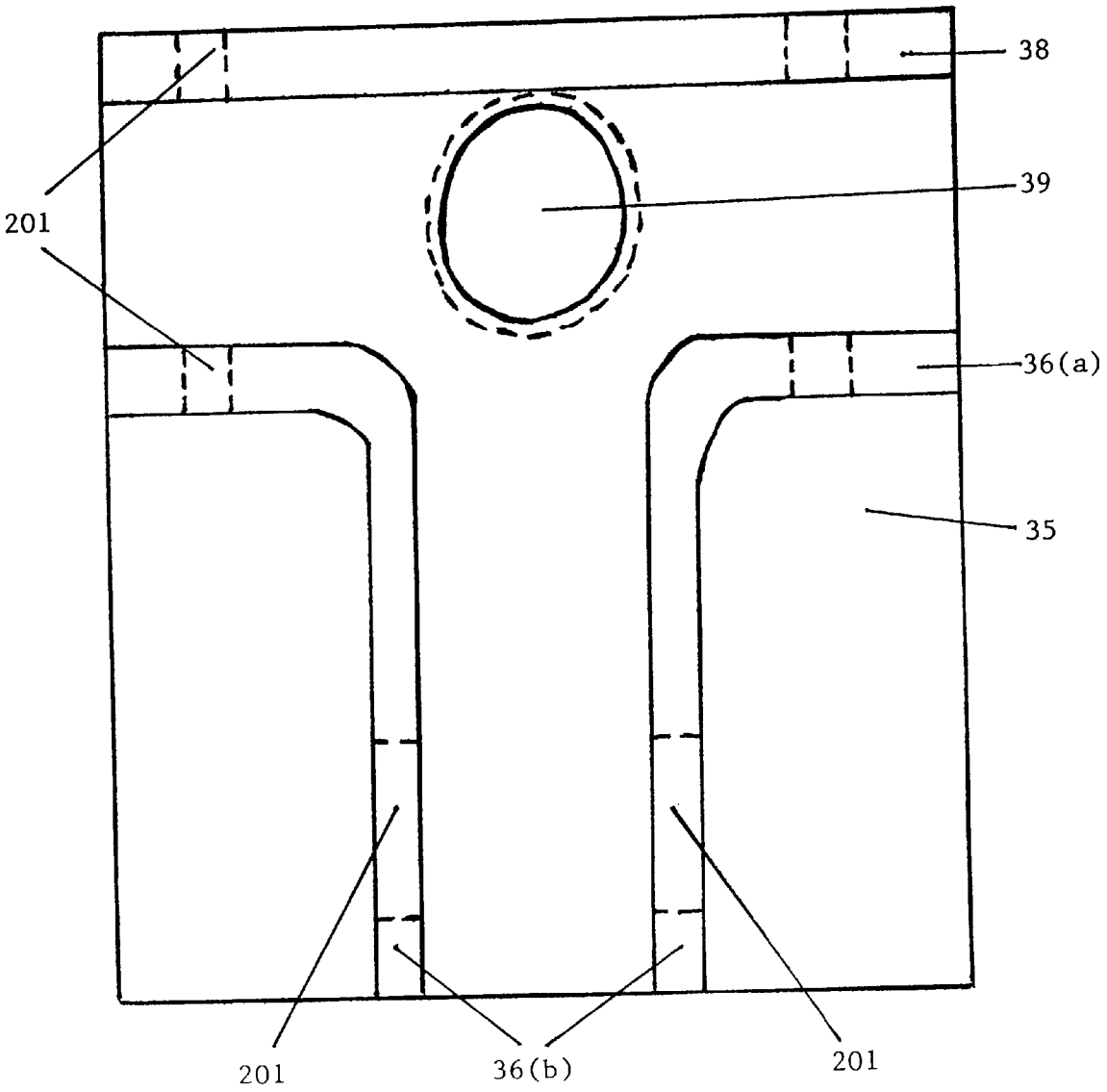
FIG. 3 depicts a top plan view of one version of a horizontal portion (35) of a mounting base, including a pair of L-walls 36(*a*) and (*b*)(comparable to 26(*a*) and (*b*) in FIG. 2), a juncture wall 38 (comparable to 28 in FIG. 2), and a portal (39); the dashed lines circling the portal are intended to demarcate the exterior wall of the stabilizing means, hidden beneath the horizontal base portion.
Figure 4:
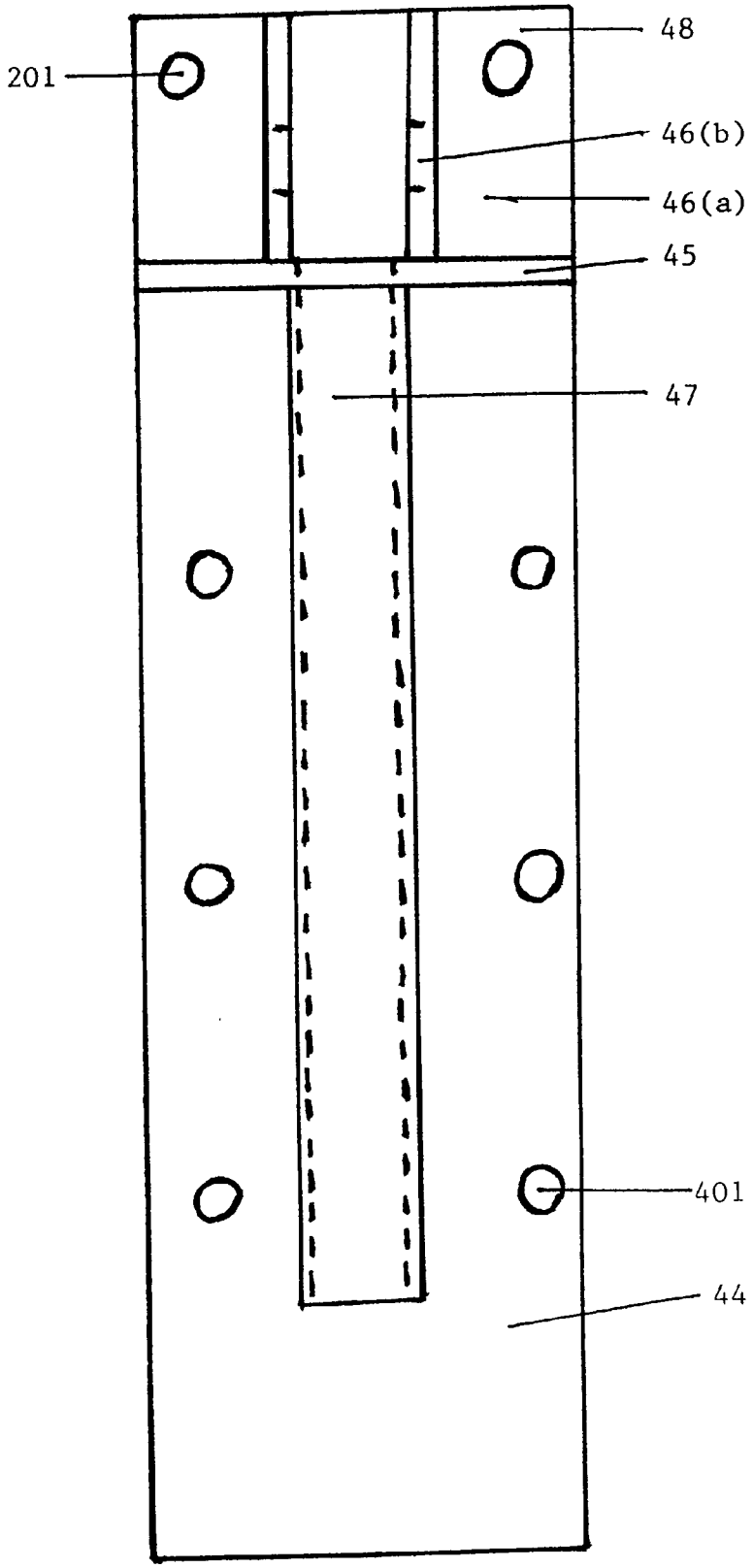
FIG. 4 depicts a front elevation view of one version of a mounting base, including a vertical portion 44 (comparable to 24 of FIG. 2), an outstanding end of horizontal portion 45 (comparable to 25 of FIG. 2), juncture wall 48 (comparable to 28 of FIG. 2) having both lateral ends hidden behind a respective portion of the mirroring L-walls 46(*a*) (comparable to 26(*a*) of FIG. 2), ends of a mirroring pair of L-walls 46(*b*) (comparable to 26(*b*) of FIG. 2), and stabilizing means (47).

One particular embodiment of the invention described above includes an apparatus wherein said upstanding walls define an intermediate channel and two opposite lateral channels (or subchannels) sharing a common terminal juncture, said channels cooperatively situated in essentially the shape of an inverted T, as observed from the perspective of somebody standing on the mooring structure and looking down at the horizontal portion of the mounting base. The wall forming the top of the T of the channels may be a separate upstanding wall firmly attached (such as welding) across the upper surface of the horizontal portion of the base, along the L juncture; see FIG. 2. (Alternatively, in one version of the base, the horizontal portion is formed by firmly attaching the edge of an essentially horizontally oriented plate to the essentially vertically oriented portion of the base, at a point allowing a section of the vertical portion to extend upwards past the juncture of the horizontal plate to thereby form a backstop wall across the top of the T channel.) Said portal through said horizontal base portion is situated within said juncture of said channels. When said mooring member is engaged when said boom arm is situated within said intermediate channel, said boom arm extends out over the water in a position to moor a watercraft floating in the vicinity of the mooring structure. On the other hand, when said mooring member is engaged when said boom arm is situated within either of said lateral channels, said boom arm extends essentially parallel and adjacent with the mooring structure.

The invention is not limited by construction materials to the extent that such materials satisfy the structural or functional requirements. For example, any materials may be used to make the mooring member and/or mounting base, so long as the materials fulfill the requirements that said components be rigid. The suitability of construction materials may be dependant upon the nature of the watercraft being moored or secured, and/or the nature of the mooring structure. Large heavy watercraft generally need a mooring apparatus made of stronger and more rigid materials than would generally be needed for a mooring apparatus for smaller light watercraft.

In one embodiment suitable for personal watercraft and dinghies, the apparatus includes a rigid mooring member comprising an essentially horizontally oriented steel boom arm having an end proximal to the mooring structure and an end distal from the mooring structure. An essentially vertically oriented steel distal leg depends downwardly from said distal end a sufficient downward distance to prevent a watercraft mooring eyelet impaled thereby from disimpaling. An essentially vertically oriented steel proximal leg depends downwardly from said proximal end a sufficient distance to allow engagement of said mooring member with a mounting base attached to the mooring structure.

Said mounting base includes a steel plate essentially in the side-view shape of an inverted L, said plate having an essentially vertically oriented portion defining a plurality of eyelet holes (401) sized and positioned to accommodate means for securing said base to the mooring structure. Said plate has an essentially horizontally oriented portion (essentially adjoining said vertical portion at said L juncture), having an upper surface and a lower surface and having an end proximal to the mooring structure and an end distal therefrom. Said upper surface of said distal end has an upstanding pair of L-shaped walls (as viewed from above looking down) essentially mirroring each other; said walls are essentially back-to-back L's separated by a channel defined by the portion of the walls that are back-to-back. Said upper surface of said proximal end of said horizontal base portion also has an upstanding wall essentially aligned along said L juncture; said juncture-aligned wall (20) cooperates with the non-back-to-back portions of the mirroring walls to define two aligned channels (or subchannels) perpendicular to the channel defined by the back-to-back wall portions. The configuration of said walls thereby define an intermediate and two opposite lateral channels joined in essentially the shape of an inverted T, from the perspective of the mooring structure, looking down at the horizontal portion of the mounting base. (As an alternative equivalent to the backstop at the top of the T being formed by attaching the upstanding juncture-aligned wall to the juncture of the horizontal and vertical base portions, the backstop may be formed by the appropriate attachment of the horizontal base portion to the vertical base portion, so that a section of the vertical base portion extends above the juncture of the horizontal base portion. Alternatively (and equivalently), the vertical base portion may be attached to an essentially vertical portion of a mooring structure, sufficiently below an essentially adjacent essentially horizontal portion of the mooring structure so that the horizontal portion of the mooring structure above said base essentially acts as a backstop comprising the top of the T channel.) Said horizontal portion of said base also defines a portal between said upper surface and said lower surface, said portal essentially comprising a hole situated at said juncture of said channels. Said portal is sized to closely accept insertion of a lowermost portion of said proximal leg of said mooring member when said boom arm is situated within one of said channels.

Said base further includes a steel stabilizing sleeve attached to said base and having its chamber opening situated directly beneath said portal. Said sleeve defines a cylindrical interior chamber sized to closely accept the insertion of a lowermost portion of said cylindrical proximal leg of said mooring member, enabling the pivoting therein of said proximal leg along its longitudinal axis until said boom arm is situated within a channel.

More particularly, said steel boom arm is constructed of square steel tubing approximately ½ inch to 2 inches in cross section and approximately 6 inches to 48 inches long. For mooring a personal watercraft with prow fronted into the mooring area of the mooring structure, the boom arm may preferably be approximately 8 inches long. For mooring a personal watercraft positioned with a side essentially parallel to the mooring area, the boom arm may preferably be approximately 30 inches long. Said steel proximal leg is selected from the group of construction materials consisting of cylindrical steel rodding or tubing approximately ½ inch to 2 inches in diameter and approximately 3 inches to 48 inches long. Said steel distal leg is selected from the group of construction materials consisting of cylindrical steel rodding or tubing approximately ½ inch to 2 inches in diameter and approximately 12 inches to 60 inches long. Said steel base plate is constructed from steel plating approximately ⅛ inch to 1 inch thick and approximately 2 inches to 12 inches wide, said vertical portion being approximately 3 inches to 12 inches long, said horizontal portion being approximately 3 inches to 12 inches long. Said steel stabilizing sleeve is constructed of steel tubing approximately 3 inches to 12 inches long and defining an interior chamber approximately ½ inch to 2 inches in diameter, attached to the lower surface of the horizontal portion, the vertical portion, or both.

Even more particularly, said boom arm is constructed of square steel tubing approximately 1 inch in cross section and approximately 30 inches long, each end also having a cylindrical bore slightly more than ⅝ inch in diameter drilled vertically through said boom arm. Said proximal leg is constructed of stainless steel rodding approximately ⅝ inch in diameter and approximately 8⅛ inches long, the uppermost end being inserted through said bore in said boom arm proximal end and firmly attached thereto (such as by welding). Said distal leg is constructed of stainless steel rodding approximately ⅝ inch in diameter and approximately 37⅛ inches long, the uppermost end being inserted through said bore in said boom arm distal end and firmly attached thereto. Said base plate is constructed of steel plating approximately ¼ inch thick, approximately 4 inches wide and having sufficient length to, when bent perpendicularly to its longitudinal plane, define a vertical portion approximately 10¼ inches long and a horizontal portion approximately 4¼ inches long. Said walls are upstanding approximately 2 inches from said upper surface of said horizontal portion and firmly attached thereon, thereby defining said intermediate channel approximately 2¾ long and slightly more than 1 inch wide; said walls also defining each of said lateral channels approximately 1⅜ inch long and slightly more than 1 inch wide. Said portal has essentially the same diameter as that of said chamber of said stabilizing sleeve into which said portal opens. Said steel stabilizing sleeve is constructed of steel tubing approximately 8⅛ inches long and defines an interior chamber slightly more than ⅝ inch in diameter.

As mentioned above, in some versions of the invention, for each pair of said upstanding walls defining a respective channel, an uppermost portion of both of said walls defines matching eyelet holes (201) sized to accept a locking device (such as a pad lock, for example) transversing said channel when said boom arm is situated within said channel.

If a mounting base cannot be secured to the mooring structure, the apparatus may further include an adaptor for securing the mooring apparatus to a horizontal surface of the mooring structure. Said adaptor includes attaching, to said horizontal portion of said inverted L base (in an essentially mirror-imaging arrangement), a horizontal portion of another member having approximately the same dimensions as said base, thereby forming an essentially T shaped assembly. One side of the T is secured to a horizontal surface of the mooring apparatus, and the other side of the T forms the horizontal portion of the base of the mooring apparatus.

Besides the apparatus described above, the invention includes a method of mooring watercraft. Said method includes, after securing an apparatus mounting base to the mooring structure, performing the steps of inserting the lowermost end of a distal leg of a boom arm of a mooring member through a hole in a vertical surface of the watercraft, and engaging said mooring member with said base by positioning said boom arm in a channel when inserting a lowermost portion of a proximal leg of said boom arm through said base portal and into a stabilizing means. An additional method step may include inserting through said matching eyelet holes in said respective paired channel walls a locking device transversing said channel. The methods are not limited by the order in which steps are performed.

We claim:

1. An apparatus for mooring watercraft, comprising:

at least one rigid mooring member comprised of at least one essentially horizontally oriented boom arm having at least one end proximal to the mooring structure and at least one end distal from the mooring structure, at least one essentially vertically oriented distal leg depending downwardly from said distal end a sufficient downward distance to prevent a watercraft impaled thereby from disimpaling, and at least one essentially vertically oriented proximal leg depending downwardly from said proximal end a sufficient distance to facilitate engagement of said mooring member with a base attached to the mooring structure;

said base comprising a rigid plate essentially in the shape of an inverted L, said plate having an essentially vertically oriented portion for securing to the mooring structure, said plate having an essentially horizontally oriented portion having an upper surface and a lower surface and having an end proximal to the mooring structure and an end distal therefrom, said upper surface of said horizontal portion having at least one upstanding pair of essentially parallel walls defining at least one channel extending along said horizontal portion from at least near said proximal end to at least near said distal end, said horizontal portion defining at least one portal between said upper surface and said lower surface, said portal sized to closely accept insertion of a lowermost portion of said proximal leg of said mooring member when said boom arm is situated within said channel, said base further comprising a means for stabilizing said proximal leg of said mooring member to facilitate the stable engagement of said proximal leg with accompanying boom arm and distal leg with said base.

2. An apparatus as described in claim 1, comprising:

a plurality of channels; and wherein said stabilizing means and said portal in said horizontal base portion are sized and adapted to facilitate pivoting of said proximal leg of said mooring member to accommodate the placement of said boom arm into said channels separately, enabling said engagement when said boom arm is situated within any one of said channels.

3. An apparatus as described in claim 2, wherein:

said proximal leg of said mooring member is cylindrical; and said stabilizing means is comprised of a rigid sleeve attached to said base and having its chamber opening situated directly beneath said portal, said sleeve defining a cylindrical interior chamber sized to closely accept the insertion of a lowermost portion of said cylindrical proximal leg of said mooring member, enabling the pivoting therein of said proximal leg along its longitudinal axis until said boom arm is situated within a channel.

4. An apparatus as described in claim 3, wherein:

said upstanding walls define an intermediate channel and two opposite lateral channels sharing a common terminal juncture, said channels in essentially the shape of an inverted T, said portal through said horizontal base portion is situated within said juncture of said channels.

5. An apparatus as described in claim 4, wherein:

when said mooring member is engaged when said boom arm is situated within said intermediate channel, said boom arm extends out over the water in a position to moor a watercraft floating in the vicinity of the mooring structure, whereas when said mooring member is engaged when said boom arm is situated within either of said lateral channels, said boom arm extends essentially parallel with the mooring structure, in an essentially out-of-the-way position awaiting use.

6. A method of mooring watercraft comprising, after securing the apparatus base of claim 1 to the mooring structure, performing the steps of:

inserting the lowermost end of a distal leg of a boom arm of a mooring member through a hole in a vertical surface of the watercraft; and engaging said mooring member with said base by positioning said boom arm in a channel when inserting a lowermost portion of a proximal leg of said boom arm through said base portal and into a stabilizing means.

7. An apparatus for mooring watercraft, comprising:

a rigid mooring member comprising an essentially horizontally oriented steel boom arm having an end proximal to the mooring structure and an end distal from the mooring structure, wherein an essentially vertically oriented steel distal leg depends downwardly from said distal end a sufficient downward distance to prevent a watercraft impaled thereby from disimpaling, and an essentially vertically oriented steel proximal leg depends downwardly from said proximal end a sufficient distance to allow engagement of said mooring member with a base attached to the mooring structure;

said base comprising a steel plate essentially in the shape of an inverted L, said plate having an essentially vertically oriented portion defining a plurality of eyelet holes sized and positioned to accommodate means for securing said base to the mooring structure, said plate having an essentially horizontally oriented portion essentially adjoining said vertical portion at said L juncture having an upper surface and a lower surface and having an end proximal to the mooring structure and an end distal therefrom, said upper surface of said distal end having an upstanding pair of L-shaped walls essentially mirroring each other, said upper surface of said proximal end having an upstanding wall essentially aligned along said L juncture, said walls defining an intermediate channel and two opposite lateral channels sharing a common terminal juncture, said channels in essentially the shape of an inverted T, said horizontal portion defining a portal between said upper surface and said lower surface situated at said juncture of said channels, said portal sized to closely accept insertion of a lowermost portion of said proximal leg of said mooring member when said boom arm is situated within one of said channels;

said base further comprising a steel stabilizing sleeve attached to said base and having its chamber opening situated directly beneath said portal, said sleeve defining a cylindrical interior chamber sized to closely accept the insertion of a lowermost portion of said cylindrical proximal leg of said mooring member, enabling the pivoting therein of said proximal leg along its longitudinal axis until said boom arm is situated within a channel.

8. An apparatus as described in claim 7 hereinabove, wherein:

said steel boom arm is constructed of square steel tubing approximately ½ inch to 2 inches in cross section and approximately 6 inches to 48 inches long;

said steel proximal leg is selected from the group of construction materials consisting of cylindrical steel rodding or tubing approximately ½ inch to 2 inches in diameter and approximately 3 inches to 48 inches long;

said steel distal leg is selected from the group of construction materials consisting of cylindrical steel rodding or tubing approximately ½ inch to 2 inches in diameter and approximately 12 inches to 60 inches long;

said steel base plate is constructed from steel plating approximately ⅛ to 1 inch thick and approximately 2 inches to 12 inches wide, said vertical portion being approximately 3 inches to 12 inches long, said horizontal being approximately 3 inches to 12 inches long; and said steel stabilizing sleeve is constructed of steel tubing approximately 3 inches to 12 inches long and defining an interior chamber approximately ½ inch to 2 inches in diameter, attached to at least said horizontal portion.

9. The apparatus as described in claim 8 hereinabove, wherein:

said boom arm is constructed of square steel tubing approximately 1 inch in cross section and selected from the group consisting of lengths approximately 8 inches long and approximately 30 inches long, each end also having a cylindrical bore slightly more than ⅝ inch in diameter drilled vertically through said boom arm;

said proximal leg is constructed of stainless steel rodding approximately ⅝ inch in diameter and approximately 8⅛ inches long, the uppermost end being inserted through said bore in said boom arm proximal end and welded thereto;

said distal leg is constructed of stainless steel rodding approximately ⅝ inch in diameter and approximately 37⅛ inches long, the uppermost end being inserted through said bore in said boom arm distal end and welded thereto;

said base plate is constructed of steel plating approximately ¼ inch thick, approximately 4 inches wide and having sufficient length to, when bent perpendicularly to a longitudinal axis, define a vertical portion approximately 10¼ inches long and a horizontal portion approximately 4¼ inches long, said walls upstanding approximately 2 inches from said upper surface of said horizontal portion and welded thereon, defining said intermediate channel approximately 2¾ long and slightly more than 1 inch wide and defining each of said lateral channels approximately 1⅜ inch long and slightly more than 1 inch wide, said portal having essentially the same diameter as that of said chamber of said stabilizing sleeve into which said portal opens; and said steel stabilizing sleeve is constructed of steel tubing approximately 8⅛ inches long and defining an interior chamber slightly more than ⅝ inch in diameter.

10. An apparatus as described in claim 9 hereinabove, wherein:

for each pair of said upstanding walls defining a respective channel, an uppermost portion of both of said walls defining matching eyelet holes sized to accept a locking device transversing said channel when said boom arm is situated within said channel.

11. An apparatus as described in claim 7 hereinabove, further comprising an adaptor for securing the mooring apparatus to a horizontal surface of the mooring structure, comprising attaching, to said horizontal portion of said inverted L base in an essentially mirror-imaging arrangement, a horizontal portion of another member having approximately the same dimensions as said base, thereby forming an essentially T shaped assembly wherein one side of the T is secured to a horizontal surface of the mooring apparatus and the other side of the T forms the horizontal portion of the base of the mooring apparatus.

12. A method of mooring watercraft comprising, after securing the apparatus base of claim 10 to the mooring structure, performing the steps of:

inserting the lowermost end of a distal leg of a boom arm of a mooring member through a hole in a vertical surface of the watercraft;

engaging said mooring member with said base by positioning said boom arm in a channel when inserting a lowermost portion of a proximal leg of said boom arm through said base portal and into a stabilizing sleeve; and inserting through said matching eyelet holes in said respective paired channel walls a locking device transversing said channel.

* * * * *